United States Patent [19]

Hahn

[11] Patent Number: 4,991,887

[45] Date of Patent: Feb. 12, 1991

[54] DEVICE FOR LOCKING A SLIDING DOOR OF A SHOWCASE HAVING A FRAME CONSTRUCTION

[75] Inventor: Till H. Hahn, Frankfurt am Main, Fed. Rep. of Germany

[73] Assignee: Glasbau Hahn GmbH & Co. KG, Frankfurt am Main, Fed. Rep. of Germany

[21] Appl. No.: 382,473

[22] Filed: Jul. 17, 1989

[30] Foreign Application Priority Data

Jul. 20, 1988 [DE] Fed. Rep. of Germany ..... 3824638

[51] Int. Cl.[5] ..... E05C 17/56

[52] U.S. Cl. ..... 292/251.5; 292/144

[58] Field of Search ..... 292/251.5, 144, 201; 335/261, 279, 281; 70/14, DIG. 19

[56] References Cited

U.S. PATENT DOCUMENTS

| | | | |
|---|---|---|---|
| 3,431,062 | 3/1969 | Melgaard | 292/251.5 |
| 4,682,801 | 7/1987 | Cook | 292/251.5 |
| 4,826,223 | 5/1989 | Geringer | 292/251.5 |
| 4,840,411 | 6/1989 | Sowersby | 292/251.5 |

*Primary Examiner*—Robert L. Wolfe

*Attorney, Agent, or Firm*—Bucknam and Archer

[57] ABSTRACT

Sliding doors of showcases are normally locked by safety locks, the installation of which must, however, be very precise when a play of the sliding door in rest position is to be avoided. By the new device a safe locking of a showcase is also to be achieved without having to pay attention to an especially precise installation. The sliding door (4) is held in the closed position and rest position, respectively, by permanent magnets (7) provided at the showcase, the magnetic force of which can be neutralized by an electric coil and direct current flowing therethrough. As the installation of the permanent magnets must not be so precise, such a showcase can be built up also outside a workshop, for instance on the building site. Furthermore, in this way the safe closure of sliding doors can be achieved when at positions where known locking means are difficult to reach.

8 Claims, 2 Drawing Sheets

DEVICE FOR LOCKING A SLIDING DOOR OF A SHOWCASE HAVING A FRAME CONSTRUCTION

BACKGROUND OF THE INVENTION

The invention relates to a device for locking a sliding door of a showcase having a face construction.

Showcases used for exhibition purposes have an opening at least at one side allowing access to the interior of the showcase and being in a condition to be closed frequently by a sliding door. For securing the sliding door in the closed position or in the rest position safety locks are used in order to protect the often valuable comtents against unauthorized access. The mounting of the safety locks must be very precise so that there is no play when the sliding door is in the closed position. Hence the mounting is very time-consuming and makes the building of such as showcase very expensive. Often the locks are difficult to get it.

SUMMARY OF THE INVENTION

The object of the invention is to develope a device for locking such a showcase which requires an easy mounting and may allow a mounting of the complete showcase at site by semi-skilled workers.

The permanent magnets at the showcase body interacting with the support member or the pole plates must not be installed precisely because they are easy to adjust. For opening the sliding door, the magnetic force of the permanent magnet(s) is neutralized temporarily by a direct current flowing through the coil of the permanent magnet(s).

It is mentioned in this connection that, particularly in the field of furniture, doors are provided with magnetic locks. They are not a protection per se but are a substitution for the time-consuming operation with a key. The doors can be opened by a light mechanic pull.

By the device according to the invention the secure closing of the sliding door can be achieved even at positions where conventional locks are hardly accessible. Preferably the support means are arranged to guide the sliding door at top and bottom.

A further development of the invention is that electric contacts of the coils of the permanent magnets are provided at the lower side or the upper side of the showcase which can be connected to an external or an internal current source.

As the contacts are provided at a hidden place, there exists a certain protection against unauthorized access to the showcases. The external power source may be a portable battery.

A further development of the invention is that a current supply means is provided in the showcase which is supplied by the public power supply system and adapted to be connected to the electric coils of the permanent magnets by switching means.

As the upper part of showcases is often provided with illuminating devices, there is anyhow a connection to the general power supply system which can also be used for the current supply means. For safety reason, the switching means may be installed in the showcase at a hidden place, e.g. under the showcase.

An advantageous further development of the invention is that the upper and/or the lower support are held in the rest position additionally by a safety lock in the locked state, that said safety lock is provided with a switching means connected to the electric coil of permanent magnet, the switching means being operable when the safety lock is opened.

As the sliding door is maintained in the closed position by the permanent magnets, the mounting of the safety lock must not be so precise at the same time providing an additional security against unauthorized entry into the case. The switching means can be activated by the safety lock so that at least the same security is reached when the showcase is locked as if it is closed only mechanically by safety locks.

Further advantages become evident from the subclaims.

DESCRIPTION OF THE DRAWINGS

The invention will now be further described by way of examples illustrated in the drawings in which.

DESCRIPTION OF PREFERRED EMBODIMENTS

Figure 1:
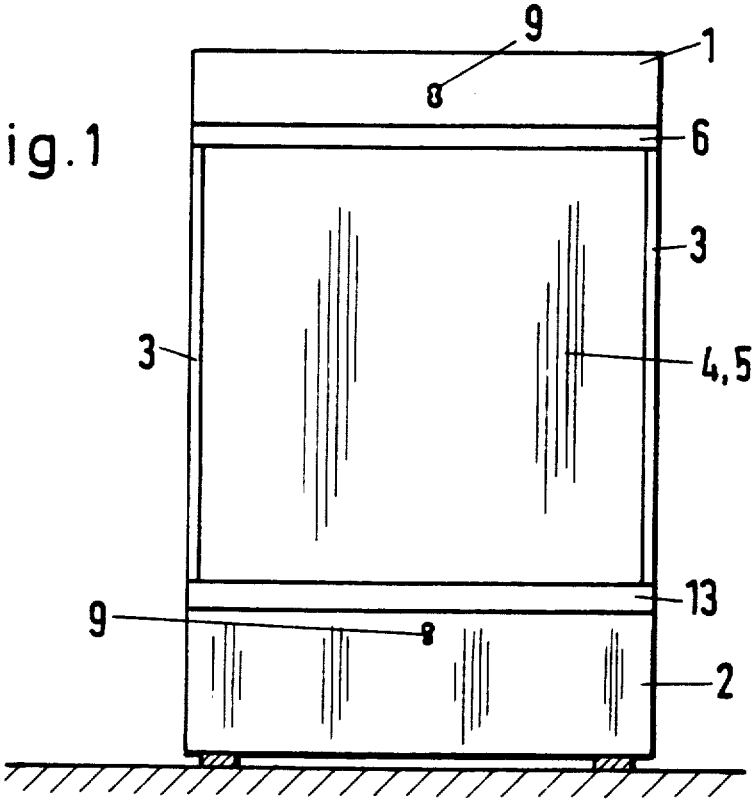
FIG. 1 is the front view of a showcase.
Figure 2A:
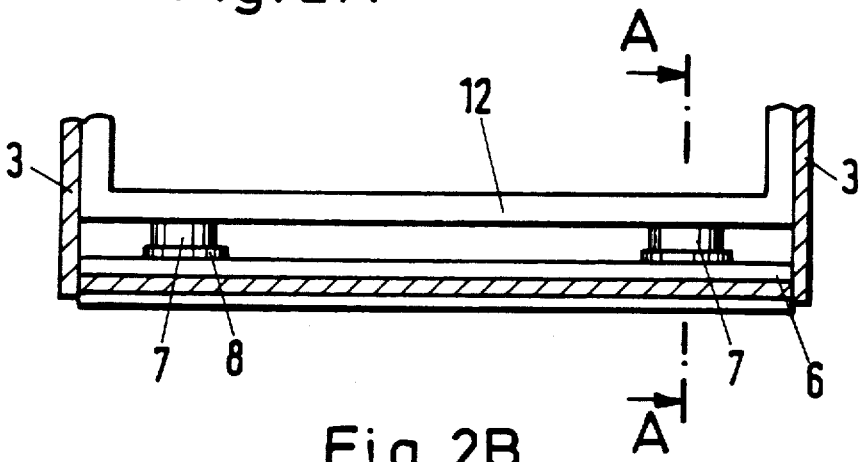
FIGS. 2A and 2B illustrate an embodiment of the invention in a showcase seen from the upper end.
Figure 2B:
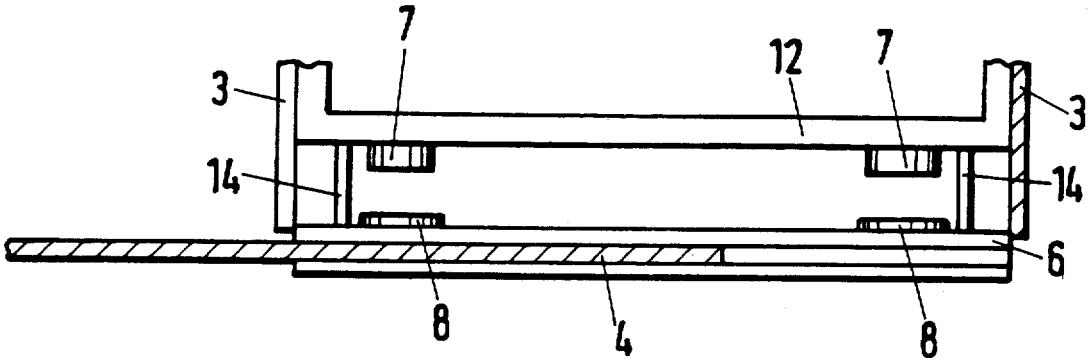

The showcase comprises of an upper part 1 and a lower part 2. Between the two parts there is the display area formed by side walls 3 and by a sliding door 4 to close the display area. The sides 3 and the sliding door 4 may be made of glass. The movable side wall is held by upper and lower support means 6 and 13, respectively.

The upper and lower support means 6 and 13, respectively holding the sliding door 4 are supported by a parallel transport means 14 fixed to the inner frame 12 of the showcase. The parallel transport means allows the horizontal movement of the support means 6 and 13, respectively, away from the showcase body so that the side door 4 is free to move away laterally to give access to the interior of the showcase.

One or a plurality of permanent magnets 7 are provided at the inner frame 12 of the showcase in such a manner that they hold the upper support 6 and the lower support 13, respectively, in the rest position of the sliding door 4 by means of pole plates 8 provided at the supports. With respect to the movable side wall 4 it will be appropriate to fix at least one permanent magnet each so that it acts upon the middle of the corresponding support means 6 and 13, respectively. Likewise, a plurality of permanent magnets 7 may act upon one support means.

Each permanent magnet 7 has an electrical coil (not shown) to neutralize the magnetic field of the permanent magnet 7. This is achieved by the flow of an electric direct current of corresponding intensity and polarity. The current source may be a battery which may be connected to the coil of the permanent magnets 7 via contacts hidden on the outer walls, e.g. under the body of the showcase.

The switching means are on the one side mechanically connected to the latch of the safety locks 9 and on the other side electrically connected to the electric coils of the permanent magnets. When the safey locks 9 are operated, the latches are moved to close the switching means so that current flows into the coils of the permanent magnets 7 to release the pole plates 8 from the permanent magnets and the sliding doors can be moved horizontally on the parallel transport means.

Further, safety locks 9 may be provided in the upper part 1 and/or lower part 2 of the showcase which hold, when locked, the transport means 6 and 13, respectively, in addition to the permanent magnets. The safety locks 9 may be provided with switching means (not shown) which are activated when the locks are opened and by causing a short-time current flow into the coils of the permant magnets while the key is turned so that the transport means 6 and 13, respectively are released. The current source is a current supply means supplied by the public system and connected by the switching means to the coils of the permanent magnets 7.

Figure 3:
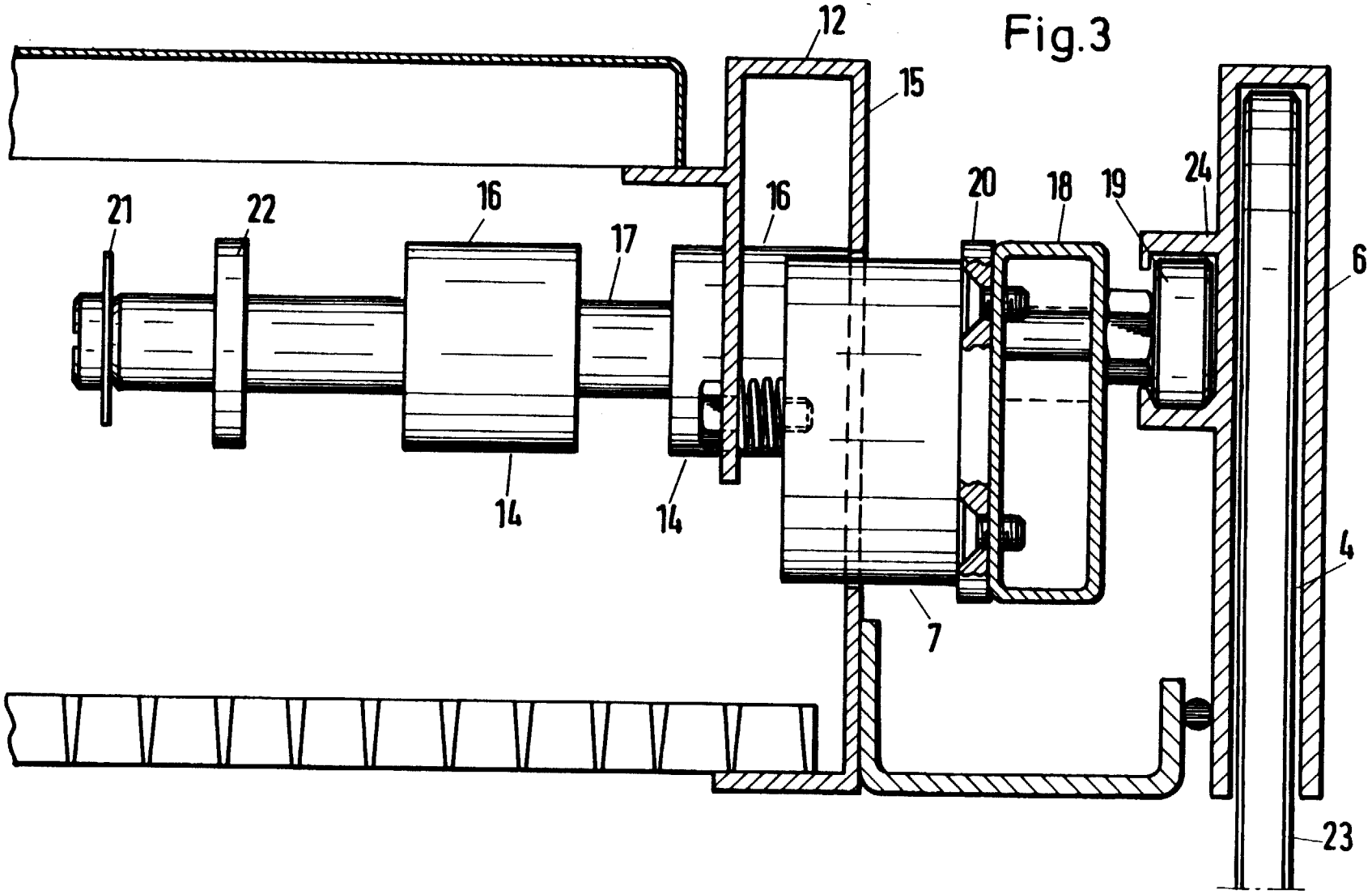
FIG. 3 is a sectional view taken along line A—A in FIG. 2A of the upper front part of a showcase body and of the upper end of a sliding door and of a device for locking the sliding door.

Details of a device for locking the sliding door are illustrated in the sectional view of FIG. 3. At the upper end of the inner frame 12 of the showcase a plurality of pairs of bearings 16 are arranged as parallel transport means in horizontal direction side by side at regular distances. Each pair of bearings 16 comprises two bearings provided on a common axis. This axis extends from the front side 15 of the inner frame 12 into the interior of the showcase and allows the mounting of a shaft 17 which extends from the space in front of the inner frame 12 into the interior of the showcase. The shafts 17 are movable in their longitudinal direction in the corresponding pairs of bearings 16. The outer ends of the shafts 17 are interconnected by a support tube 18. The support tube 18 is provided with a plurality of support rollers 19. A plurality of permanent magnets 7, e.g. permanent electric clamping magnets, are fixed to the front part 15 of the inner frame 12 and are formed as ring magnets with a coil inside as they are produced by Binder Magnete GmbH, D-7730 Villingen-Schwenningen. At the surface of the support tube 18 opposite the outer pole face of the magnets 7 pole plates 20 are provided which are made of magnetically conductive material.

Stoppers 21 are fixed at the ends of the shafts 17 extending into the interior of the showcase; one buffer 22 each is provided on each shaft between said stopper 21 and the bearing.

At the front plate of the lower part 2 of the showcase corresponding pairs of bearing 16 are provided as parallel transport means in which shafts are mounted also extending into the interior of the showcase. The outer ends of said shafts are also interconnected by a support tube, and a plurality of support rollers are fixed to the support tube in a horizontal row.

The sliding door 4 of the showcase comprises a glass pane 23 supported at the upper end by the upper support means 6 and at the lower end of the lower support means 13. The upper support means 6 and the lower support means 13 are made of profiled bars made of aluminum. The upper support means 6 and the lower support means 13 have projecting slide rails 24 by which the support means engage the support rollers 19 arranged side by side. In this way the glass pane 23 is mounted movably.

The support rollers 18 and hence the sliding door 4 are movable outwards by means of the shafts 17 horizontally movable in the bearings 16 till the stopper is stopped via the buffer 22 by the inner face of the inner bearing 16. To effect such a movement of the sliding door 4, the attraction of the permanent magnets 7 must, however, be interrupted by sending a direct current through the corresponding coil of the permanent magnets 7. When the sliding door has been moved outwards, the magnets do no longer act upon the pole plates at the support tubes 18—even if the direct current in their coil is interrupted. The sliding door which is moved outwards can now be moved laterally by means of the suppoprt rollers 19.

The direct current supplied to the coils of the permanent magnets 7 can be supplied via a rectifier by the public power supply system or via a battery. The switch for the supply line is provided either at a hidden place at the showcase or integrated in a showcase lock.

For closing the sliding door 4 is moved first by means of the support rollers laterally before the opening of the showcase body and then moved towards said opening by means of the shafts 17 of the parallel transport means 14 until the permanent magnets 7 engage the pole plates 20.

I claim:

1. A device for locking a sliding door of a showcase having a frame construction in the showcase body, the sliding door comprising a glass pane and at lease one support member (6, 13) and the glass pane aligning in the closed position of the sliding door with other parts of the showchase body, which comprises parallel transport means (14) fixed to the frame construction whereby the sliding door (4) is opened by moving horizontally thereon and by shifting laterally by means of said at least one support member, at least one permanent magnet (7) in the showcase body holding said at least one support member directly or by means of a member (8) in the rest position of the sliding door, said support member or said member (8) consisting of magnetic flux conductive material, said permanent magnet (7) having an electric coil which releases the horizontal and lateral movement of the sliding door (4) when a direct electric current flows by neutralizing the magnetic holding force.

2. The device according to claim 1 wherein two support members (6, 13) are provided and said support members consist of an upper support and a lower support respectively at the sliding door (4).

3. The device according to claim 2, wherein at least one support member consists of a pole plate (8) provided at the sliding door.

4. The device according to claim 1 wherein said showcase has an upper surface and a lower surface, at the lower surface or at the upper surface of the showcase body electric contacts are provided for the flow of an external current.

5. The device according to claim 4 wherein said external current is supplied by the public power supply system and switching means are electrically connected to the electric coil of the permanent magnet (7).

6. The device according to claim 5 wherein the sliding door (4) is held in the closed position by at least one additional safety lock, said safety lock (9) is connected with said switching means connected to the coil of the permanent magnet (7), the switching means being activated in combination with the safety lock.

7. The device according to claim 1 wherein the frame construction comprises a front part of an inner frame, a plurality of permanent magnets are fixed to the front part of said inner frame.

8. The device according to claim 1 wherein said switching means are installed under said showcase body.

* * * * *